US005820213A

United States Patent [19]

Severinski

[11] Patent Number: 5,820,213

[45] Date of Patent: Oct. 13, 1998

[54] TRIM COVER ATTACHMENT FEATURE

[75] Inventor: Paul Severinski, Southgate, Mich.

[73] Assignee: Lear Corporation, Southfield, Mich.

[21] Appl. No.: 899,274

[22] Filed: Jul. 23, 1997

[51] Int. Cl.[6] ..... A47C 31/02

[52] U.S. Cl. ..... 297/218.5; 297/218.1; 297/218.3; 297/228.13; 24/336

[58] Field of Search ..... 297/218.1, 218.3, 297/218.5, 220, 228.13; 24/336, 531

[56] References Cited

U.S. PATENT DOCUMENTS

| | | | |
|---|---|---|---|
| 3,871,041 | 3/1975 | Plume | 297/218.1 X |
| 3,928,898 | 12/1975 | Smoot | 297/218.1 |
| 3,981,534 | 9/1976 | Wilton | 297/218.1 |
| 5,409,198 | 4/1995 | Roick | 24/336 X |
| 5,478,134 | 12/1995 | Bernard et al. | 297/218.1 |
| 5,653,503 | 8/1997 | Taggart | 297/218.5 |

FOREIGN PATENT DOCUMENTS

| | | | |
|---|---|---|---|
| 372340 | 6/1990 | European Pat. Off. | 297/228.13 |
| 593041 | 11/1977 | Switzerland | 297/228.13 |

*Primary Examiner*—Peter R. Brown
*Attorney, Agent, or Firm*—Brooks & Kushman P.C.

[57] ABSTRACT

A vehicle seat assembly includes a trim cover having a trim cover edge, and a seat frame component with a frame edge. A single J-strip is adapted for attachment to the trim cover edge. The single J-strip includes a substantially flat portion attachable to the trim cover edge and a first hook portion extending from the flat portion. A double J-strip includes a second hook portion adapted for attachment to the first hook portion, and a third hook portion adapted for attachment to the seat frame.

2 Claims, 2 Drawing Sheets

TRIM COVER ATTACHMENT FEATURE

TECHNICAL FIELD

The present invention relates to a trim cover attachment feature, and more particularly to an apparatus for attaching a trim cover to a seat frame edge, wherein the trim cover is attached to the frame edge at a position spaced away from the frame edge for clearance from obstructions.

BACKGROUND OF THE INVENTION

Referring to FIG. 1, a seat assembly generally includes a cushion 10, which is supported by a frame 12, and covered by a trim cover 14. In order to secure the trim cover 14 over the cushion 10 onto the seat frame 12, the trim cover edge 16 is typically provided with a J-strip 18 secured thereto to facilitate attachment to the frame 12. The J-strip 18 is typically pulled to a position adjacent the frame edge 20, and the J-strip 18 is tucked under the frame edge 20 in order to attach the J-strip 18 to the frame edge 20.

However, as illustrated in FIGS. 1 and 3, an obstruction, such as a power adjuster 22, may be positioned closely adjacent the frame edge 20. This close positioning of the power adjuster 22, or other such device, causes great difficulty in attachment of a J-strip 18 to the frame edge 20. Interference caused by the adjuster 22 makes it difficult for the assembler to insert the J-strip 18 underneath the frame edge 20 and to tuck the J-strip up under the frame 20 for attachment. Other assemblies require the entire J-strip to be inserted past the frame edge 20 beneath the seat frame 12 for attachment to other attachment features beneath the frame, such as frame support wires, etc. This type of assembly requires that the assembler insert the J-strip by hand between the frame edge 20 and the power adjuster 22, which may be cumbersome and time-consuming.

Accordingly, it is desirable to provide an apparatus for securing a trim cover edge to a seat frame or like structure in a manner which provides clearance from the seat frame edge and power adjuster for quick attachment of the trim cover edge.

DISCLOSURE OF THE INVENTION

The present invention overcomes the above-referenced shortcomings of prior art trim cover attachment assemblies by providing a trim cover attachment device which includes a double J-strip having one hook portion attachable to the frame component and another hook portion spaced away from the frame edge to facilitate clearance for quick attachment of a J-strip thereto.

More specifically, the present invention provides an apparatus for attaching a trim cover edge to a seat frame in a vehicle in which a single J-strip is adapted for attachment to the trim cover edge. The single J-strip includes a substantially flat portion which is attachable to the trim cover edge, and a first hook portion extending from the flat portion. A double J-strip includes a second hook portion adapted for attachment to the first hook portion, and a third hook portion adapted for attachment to the seat frame.

In a preferred embodiment, the seat frame includes a protrusion extending therefrom adjacent the frame edge. The double J-strip includes an attachment feature for snap-on cooperation with the protrusion.

Accordingly, an object of the present invention is to provide an apparatus for attaching a trim cover to a seat frame in a manner in which clearance is provided from the seat frame edge and from a power adjuster, or other device, positioned closely beneath the seat frame edge.

A further object of the present invention is to provide a J-strip design which is easily aligned on the trim cover edge for sewing, and is configured to facilitate handling.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
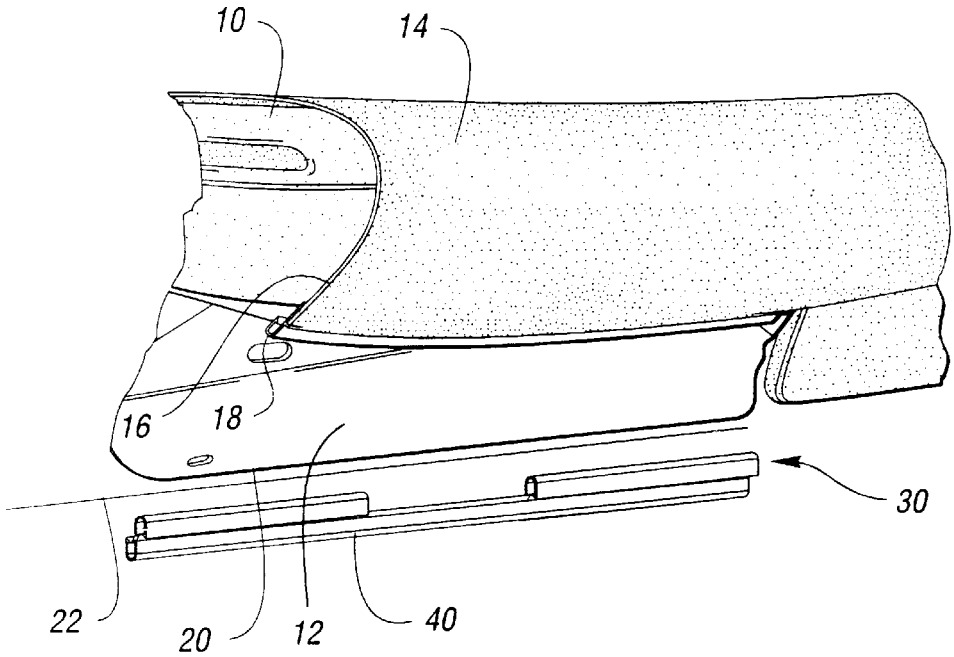
FIG. 1 shows a partially cut-away, partially exploded side view of a vehicle seat assembly in accordance with the present invention.
Figure 2:
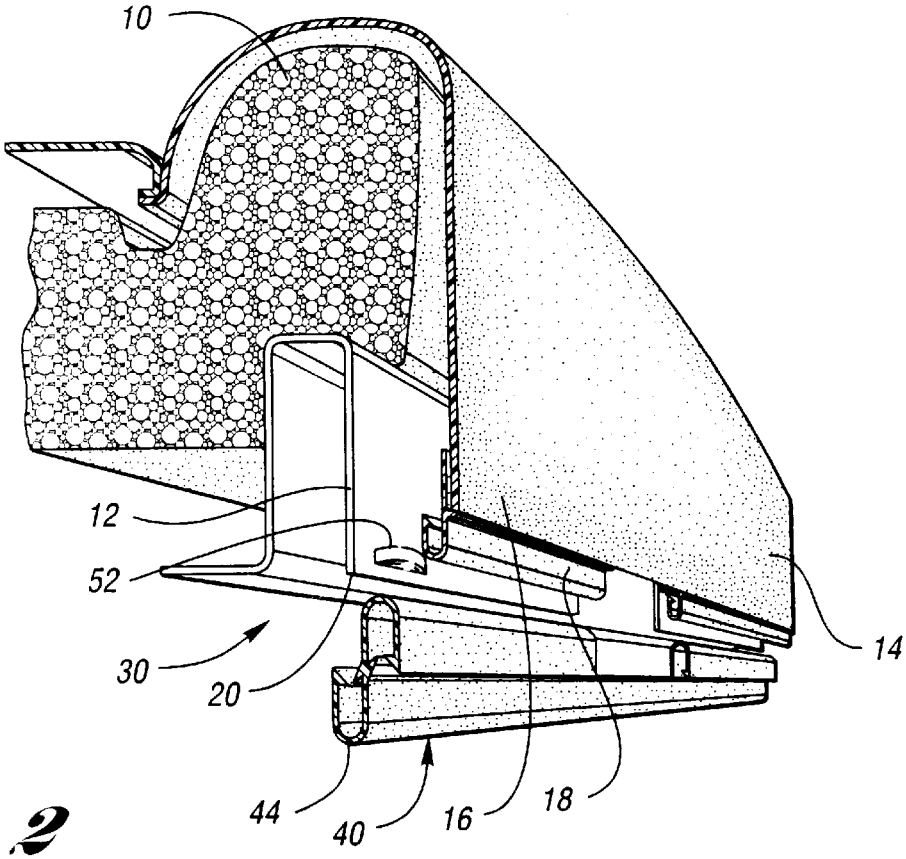
FIG. 2 shows a partially exploded, cut-away perspective view of a seat assembly in accordance with the embodiment shown in FIG. 1.
Figure 3:
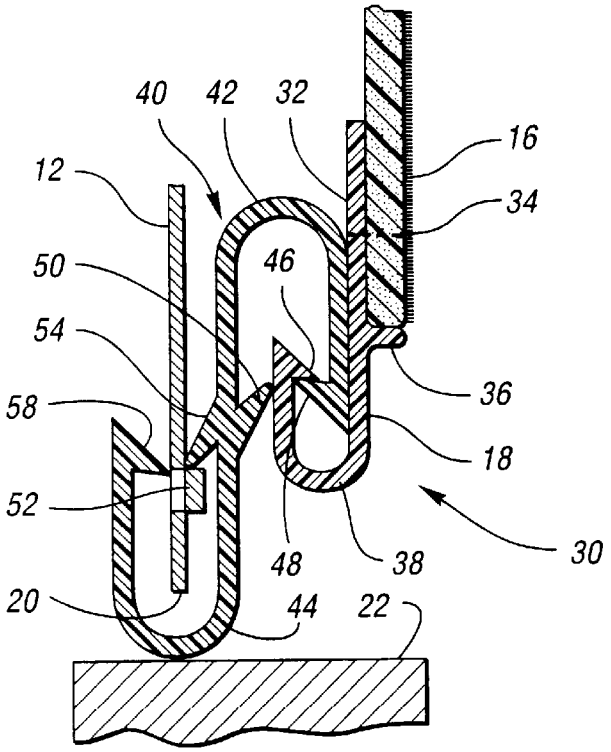
FIG. 3 shows a vertical cross-sectional view of a vehicle seat assembly in accordance with the present invention.
Figure 4:
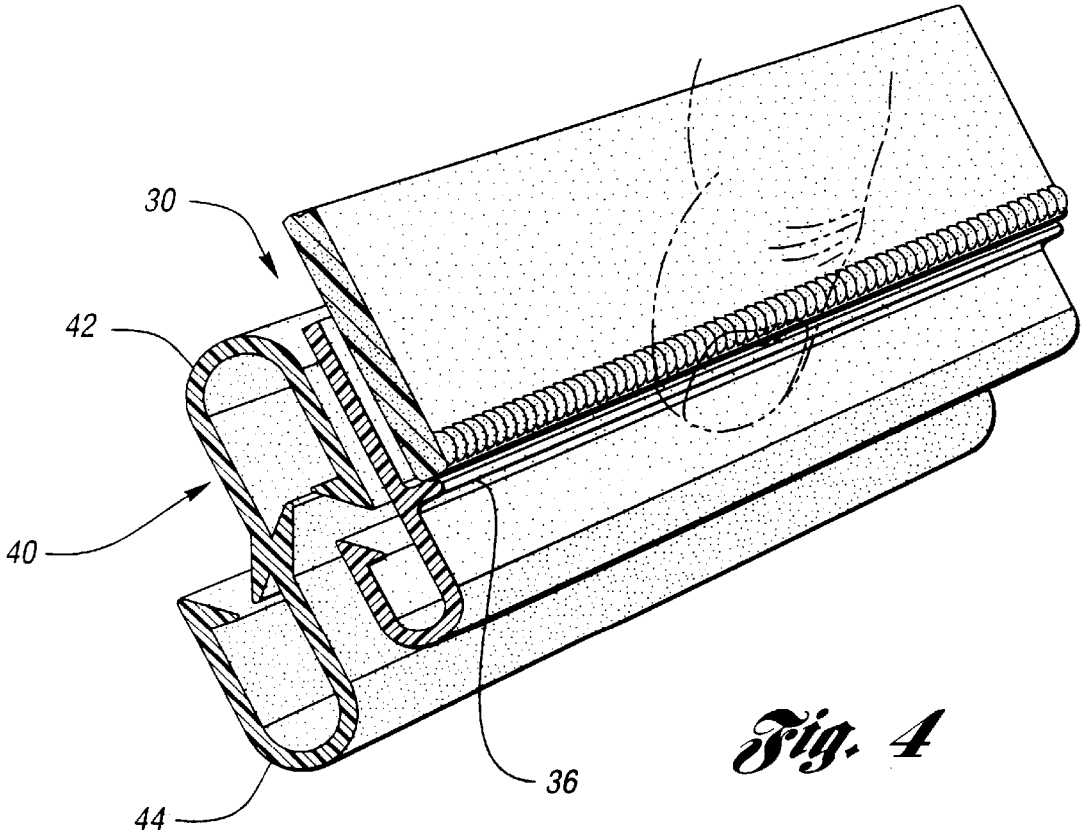
FIG. 4 shows a perspective view of a trim cover edge being attached to a double J-strip in accordance with the present invention.

Referring to FIGS. 1–4, the trim edge attachment assembly 30 is shown in accordance with the present invention. As shown, the trim edge attachment assembly 30 includes a single J-strip 18 adapted for attachment to the trim cover edge 16. The single J-strip 18 includes a substantially flat portion 32 which is sewn to the trim cover edge 16, as illustrated by the stitch line 34. The single J-strip 18 also includes a longitudinally extending rib 36 protruding therefrom to facilitate alignment of the trim cover edge 16 for sewing, and also to facilitate handling for engagement, as illustrated in FIG. 4. The operator simply pushes up on the rib 36 for attachment.

The single J-strip 18 also includes a first hook portion 38 extending from the flat portion 32.

The trim edge attachment assembly 30 also includes a double J-strip 40 having a second hook portion 42 adapted for attachment to the first hook portion 38, and a third portion 44 adapted for attachment to the seat frame edge 20.

Referring to FIG. 3, the first hook portion 38 includes a first detent 46 extending from a distal end thereof. The second hook portion 42 includes a second detent 48 extending from a distal end thereof for engagement with the first detent 46. The second hook portion 42 also includes a first snap feature 50 extending toward the second detent 48 to facilitate snap-in engagement of the first detent 46 with the second detent 48 as the first hook portion 38 is inserted into the second hook portion 42.

Still referring to FIG. 3, the seat frame component 12 also includes a protrusion 52 extending therefrom adjacent the frame edge 20. The double J-strip 40 includes a flexible attachment feature 54 extending therefrom for snap-on cooperation with the protrusion as the double J-strip 40 is inserted over the frame edge 20. The third hook portion 44 also includes a stand-off 58 extending toward the attachment feature 54 for facilitating a tight fit between the double J-strip 40 and the seat frame 12.

The double J-strip 40 is preferably attached to the seat frame 12 prior to installation of the seat frame to avoid interference with the power adjuster 22. Accordingly, with the double J-strip 40 attached to and extending from the seat frame 12, the J-strip 18 may be easily pulled to a position adjacent the double J-strip 40, and snapped into position within the second hook portion 42 for attaching the trim cover edge 16 with respect to the seat frame 12. This apparatus provides sufficient clearance from the power adjuster 22 such that no interference situation exists, and assembly time may be significantly reduced.

This invention may be used for attaching trim covers to components other than vehicle seat frames, such as armrests, etc.

The single J-strip 18 and double J-strip 40 are preferably extruded plastic components.

While the best mode for carrying out the invention has been described in detail, those familiar with the art to which this invention relates will recognize various alternative designs and embodiments for practicing the invention within the scope of the appended claims.

What is claimed is:

1. A vehicle seat assembly including a trim cover having a trim cover edge, comprising:

a seat frame component having a frame edge with a protrusion extending from the frame component adjacent the frame edge;

a single J-strip adapted for attachment to the trim cover edge, said single J-strip including a substantially flat portion attachable to the trim cover edge and a first hook portion extending from the flat portion;

an S-shaped strip having a second hook portion adapted for attachment to the first hook portion, and a third hook portion adapted for attachment to the seat frame, with a central flat portion connecting said second and third hook portions;

wherein said first hook portion includes a first detent extending from a distal end thereof, and said second hook portion includes a second detent extending from a distal end thereof for engagement with the first detent; and wherein said central flat portion further comprises a first protruding snap member extending toward the second detent for facilitating snap-in engagement of the first detent with the second detent, and a second protruding snap member extending for snap-in cooperation with said protrusion on the frame component.

2. The apparatus of claim 1, wherein said flat portion of said single J-strip comprises a longitudinally extending rib protruding therefrom to facilitate alignment of the trim cover edge for attachment, and to facilitate handling for engagement with the second hook portion.

* * * * *